US006286177B1

(12) United States Patent
Robinson

(10) Patent No.: US 6,286,177 B1
(45) Date of Patent: Sep. 11, 2001

(54) UNDER CABINET VACUUM DEVICE

(76) Inventor: Haji Lovelle Robinson, 4 Las Moradas Cir., San Pablo, CA (US) 94806

( * ) Notice: Subject to any disclaimer, the term of this patent is extended or adjusted under 35 U.S.C. 154(b) by 0 days.

(21) Appl. No.: 09/518,523

(22) Filed: Mar. 4, 2000

(51) Int. Cl.[7] ..... A47L 5/38
(52) U.S. Cl. ..... 15/301; 15/310; 15/352
(58) Field of Search ..... 15/301, 310, 352

(56) References Cited

U.S. PATENT DOCUMENTS

| | | | | |
|---|---|---|---|---|
| 2,810,028 | * | 10/1957 | Hopper | 15/301 |
| 3,027,587 | * | 4/1962 | Bierstock | 15/301 |
| 3,027,588 | * | 4/1962 | Bierstock | 15/301 |
| 4,947,510 | | 8/1990 | English | 15/310 |
| 4,977,638 | | 12/1990 | Best | 15/301 |
| 5,205,013 | * | 4/1993 | Lopes | 15/301 |
| 5,279,016 | | 1/1994 | Klassen | 15/301 |
| 5,408,721 | | 4/1995 | Wall et al. | 15/301 |
| 5,504,967 | * | 4/1996 | Graham | 15/301 |
| 5,588,175 | | 12/1996 | Zahner | 15/310 |
| 5,946,768 | * | 9/1999 | Kelly | 15/310 |
| 5,953,788 | * | 9/1999 | Douglas | 15/310 |
| 6,108,858 | * | 8/2000 | Smith | 15/301 |
| 6,158,080 | * | 12/2000 | Schlapkohl | 15/301 |

* cited by examiner

*Primary Examiner*—Robert J. Warden, Sr.
*Assistant Examiner*—Theresa T. Snider
(74) *Attorney, Agent, or Firm*—Goldstein Law Offices, P.C.

(57) ABSTRACT

An under cabinet vacuum device including an intake fan disposed interiorly of a cabinet. A collection bin is removably disposed interiorly of the cabinet forwardly of the intake fan. The collection bin has a top wall, a bottom wall, an open rear, an open front and opposed side walls. The open rear is aligned with the intake fan. An intake vent is positioned through a lower wall of the cabinet on a flooring surface that the cabinet is positioned on. The intake vent is made up of a forward plate and a rearward plate with a channel disposed therebetween. The forward plate has an open lower end in communication with the channel. The open lower end is exposed to the flooring surface. The rearward plate has an open upper end in communication with the channel. The open upper end is exposed to the open front of the collection bin.

7 Claims, 3 Drawing Sheets

UNDER CABINET VACUUM DEVICE

BACKGROUND OF THE INVENTION

The present invention relates to an under cabinet vacuum device and more particularly pertains to allowing swept up debris to be collected without the need for a dustpan or the like.

The normal collection of debris and dust is normally accomplished with the use of a broom. The debris and dust are swept into a pile and then the broom pushes the debris and dust onto a dustpan. The dustpan is then lifted to a trash can where the debris and dust are then dumped for permanent disposal. This process involves bending and stooping and normally results in the transfer of dust particles that remain on the dustpan after use. This results in remaining dirt and filth that will require a more immediate cleaning.

What is needed is a device that will allow debris and dust to be collected without much physical effort and which will remove all significant debris and dust once collected.

The present invention attempts to solve the abovementioned problem by providing a vacuuming device that is stored underneath a kitchen cabinet that will suck up all the collected debris and dust and store it for eventual permanent disposal.

The use of dust and debris collection devices is known in the prior art. More specifically, dust and debris collection devices heretofore devised and utilized for the purpose of collecting dust and debris for disposal are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,947,510 to English discloses a vacuum box for collecting small particles. U.S. Pat. No. 4,977,638 to Best discloses a dust collection apparatus. U.S. Pat. No. 5,279,016 to Klassen discloses a vacuum outlet for built in vacuum. U.S. Pat. No. 5,408,721 to Wall et al. discloses an automatic dustpan member for central vacuum cleaning system. U.S. Pat. No. 5,588,175 to Zahner discloses a foot vacuum.

While these devices fulfill their respective, particular objective and requirements, the aforementioned patents do not describe an under cabinet vacuum device for allowing swept up debris to be collected without the need for a dustpan or the like.

In this respect, the under cabinet vacuum device according to the present invention substantially departs from the conventional concepts and designs of the prior art, and in doing so provides an apparatus primarily developed for the purpose of allowing swept up debris to be collected without the need for a dustpan or the like.

Therefore, it can be appreciated that there exists a continuing need for a new and improved under cabinet vacuum device which can be used for allowing swept up debris to be collected without the need for a dustpan or the like. In this regard, the present invention substantially fulfills this need.

SUMMARY OF THE INVENTION

In the view of the foregoing disadvantages inherent in the known types of dust and debris collection devices now present in the prior art, the present invention provides an improved under cabinet vacuum device. As such, the general purpose of the present invention, which will be described subsequently in greater detail, is to provide a new and improved under cabinet vacuum device which has all the advantages of the prior art and none of the disadvantages.

To attain this, the present invention essentially comprises a cabinet having an upper wall, a lower wall, a rear wall, and an open front. The open front has a door hingedly coupled thereto. The lower wall has an opening therethrough inwardly of the open front. The cabinet is positionable on an existing floor surface. An intake fan is disposed interiorly of the cabinet. The intake fan is disposed within a generally rectangular housing. The housing is secured to the lower wall of the cabinet inwardly of the rear wall thereof. The housing has an open forward wall. The open forward wall has a filter removably disposed therein. The intake fan is powered by a motor. The motor has a power switch disposed within the door of the cabinet. A collection bin is removably disposed interiorly of the cabinet forwardly of the intake fan. The collection bin has a generally rectangular configuration defined by a top wall, a bottom wall, an open rear, an open front and opposed side walls. The side walls each have a handle secured thereto. The open rear is aligned with the filter of the housing of the intake fan. An intake vent is positioned within the opening in the lower wall of the cabinet. The intake vent is comprised of a forward plate and a rearward plate with a channel disposed therebetween. The forward plate has an open lower end in communication with the channel. The open lower end is exposed to the existing flooring surface. The rearward plate has an open upper end in communication with the channel. The open upper end is exposed to the open front of the collection bin.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved under cabinet vacuum device which has all the advantages of the prior art dust and debris collection devices and none of the disadvantages.

It is another object of the present invention to provide a new and improved under cabinet vacuum device which may be easily and efficiently manufactured and marketed.

It is a further object of the present invention to provide a new and improved under cabinet vacuum device which is of durable and reliable construction.

An even further object of the present invention is to provide a new and improved under cabinet vacuum device which is susceptible of a low cost of manufacture with regard to both materials and labor, and which accordingly is then susceptible of low prices of sale to the consuming public, thereby making such an under cabinet vacuum device economically available to the buying public.

Even still another object of the present invention is to provide a new and improved under cabinet vacuum device for allowing swept up debris to be collected without the need for a dustpan or the like.

Lastly, it is an object of the present invention to provide a new and improved under cabinet vacuum device including an intake fan disposed interiorly of a cabinet. A collection bin is removably disposed interiorly of the cabinet forwardly of the intake fan. The collection bin has a top wall, a bottom wall, an open rear, an open front and opposed side walls. The open rear is aligned with the intake fan. An intake vent is positioned through a lower wall of the cabinet on a flooring surface that the cabinet is positioned on. The intake vent is comprised of a forward plate and a rearward plate with a channel disposed therebetween. The forward plate has an open lower end in communication with the channel. The open lower end is exposed to the flooring surface. The rearward plate has an open upper end in communication with the channel. The open upper end is exposed to the open front of the collection bin.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
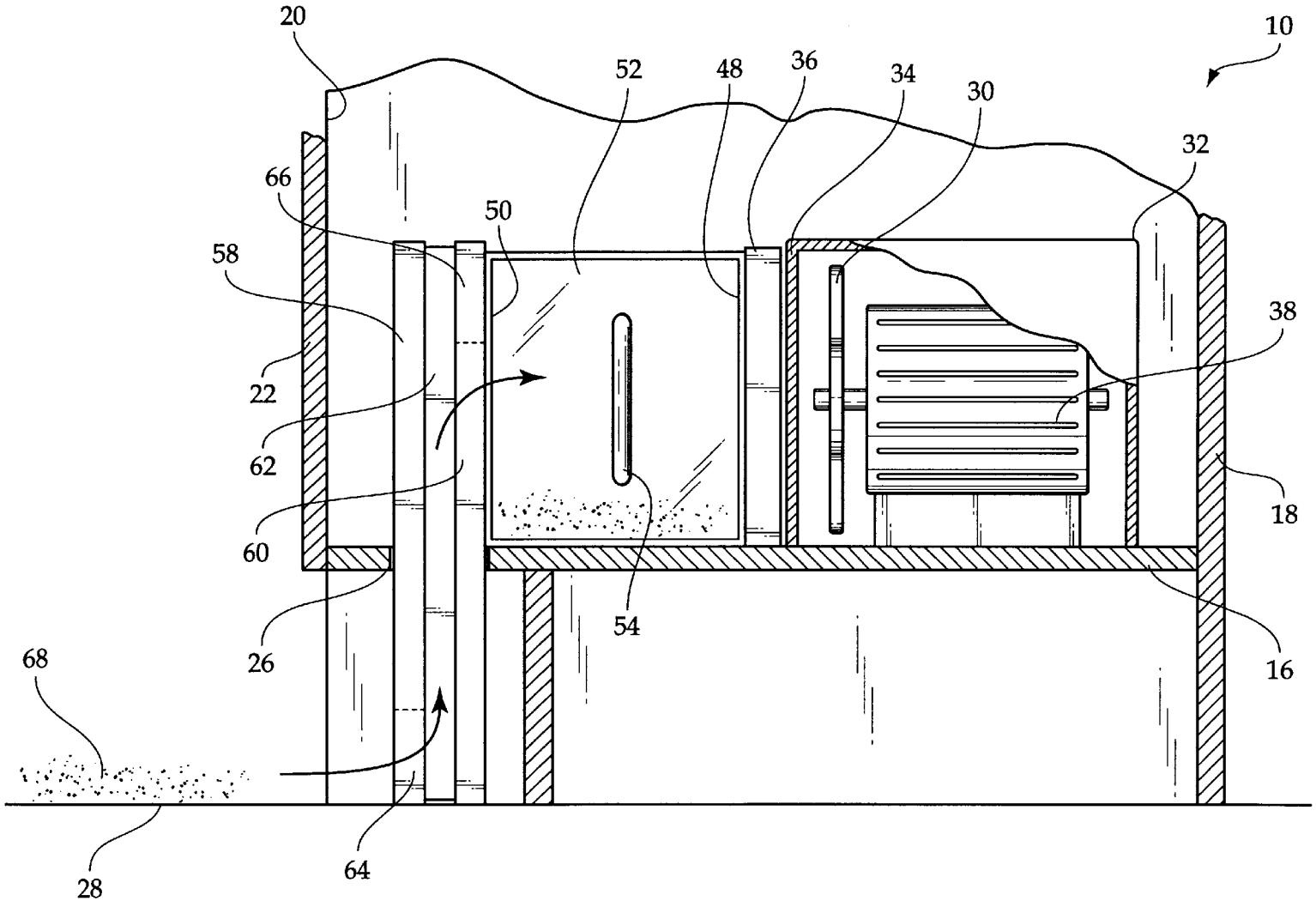
FIG. 1 is a perspective view of the preferred embodiment of the under cabinet vacuum device constructed in accordance with the principles of the present invention.
Figure 2:
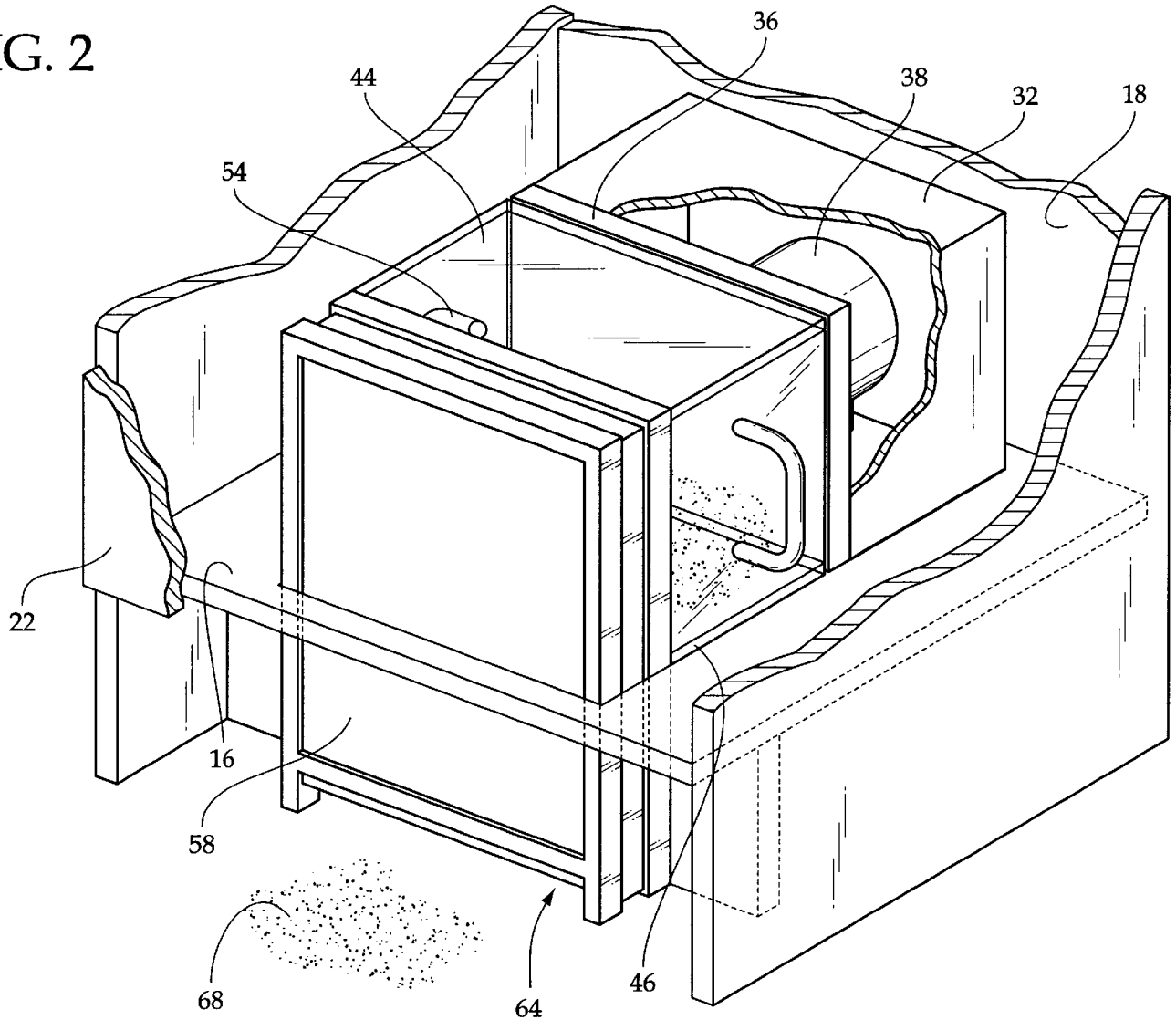
FIG. 2 is a perspective view of the present invention illustrated in partial cross-section.
Figure 3:
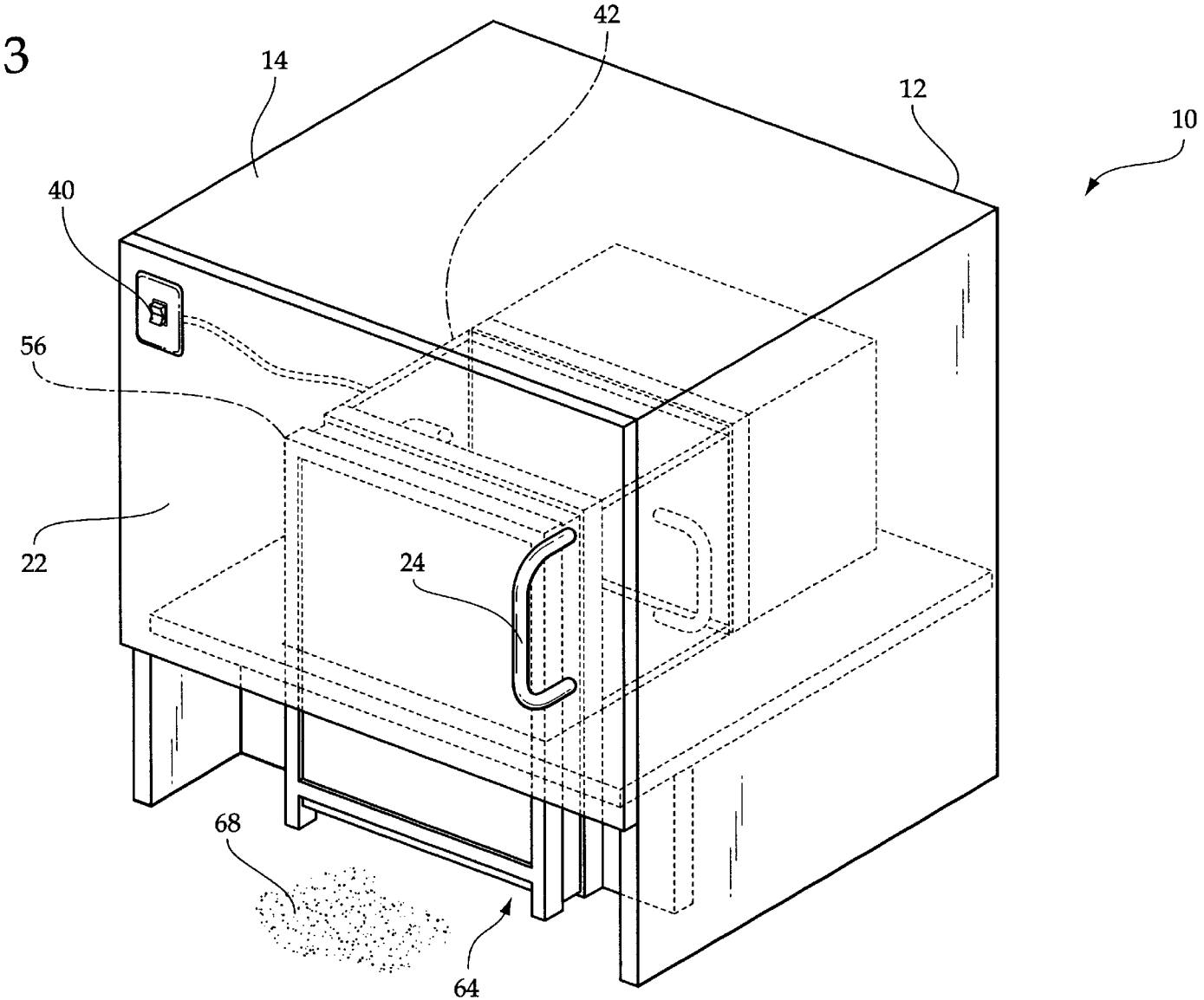
FIG. 3 is a perspective view of the present invention illustrated in use.

With reference now to the drawings, and in particular, to FIGS. 1 through 3 thereof, the preferred embodiment of the new and improved under cabinet vacuum device embodying the principles and concepts of the present invention and generally designated by the reference number 10 will be described.

Specifically, it will be noted in the various Figures that the device relates to a under cabinet vacuum device for allowing swept up debris to be collected without the need for a dustpan or the like. In its broadest context, the device consists of a cabinet, an intake fan, a collection bin and an intake vent. Such components are individually configured and correlated with respect to each other so as to attain the desired objective.

The cabinet 12 has an upper wall 14, a lower wall 16, a rear wall 18, and an open front 20. The open front 20 has a door 22 hingedly coupled thereto. The door 22 preferably includes a handle 24 to ease in the opening and closing thereof. The lower wall 16 has an opening 26 therethrough inwardly of the open front 20. The cabinet 12 is positionable on an existing floor surface 28. Note FIG. 1.

The intake fan 30 is disposed interiorly of the cabinet 12. The intake fan 30 is disposed within a generally rectangular housing 32. The housing 32 is secured to the lower wall 16 of the cabinet 12 inwardly of the rear wall 18 thereof. The housing 32 has an open forward wall 34. The open forward wall 34 has a filter 36 removably disposed therein. The intake fan 30 is powered by a motor 38. The motor 38 is preferably powered through the connection with a standard electrical outlet. The motor 38 has a power switch 40 disposed within the door 22 of the cabinet 12. The power switch 40 will preferably blend in with the decor of the cabinet 12. Alternately, the power switch 40 could be positioned interiorly of the cabinet 12 to prevent accidental use or exposure to children.

The collection bin 42 is removably disposed interiorly of the cabinet 12 forwardly of the intake fan 30. The collection bin 42 has a generally rectangular configuration defined by a top wall 44, a bottom wall 46, an open rear 48, an open front 50 and opposed side walls 52. The side walls 52 each have a handle 54 secured thereto. The open rear 48 is aligned with the filter 36 of the housing 32 of the intake fan 30.

The intake vent 56 is positioned within the opening 26 in the lower wall 16 of the cabinet 12. The intake vent 56 is comprised of a forward plate 58 and a rearward plate 60 with a channel 62 disposed therebetween. The forward plate 58 has an open lower end 64 in communication with the channel 62. The open lower end 64 is exposed to the existing flooring surface 28. The rearward plate 60 has an open upper end 66 in communication with the channel 62. The open upper end 66 is exposed to the open front 50 of the collection bin 42.

In use, the flooring surface 28 is swept using a broom or other similar sweeping instrument. The dust and debris accumulated from the sweeping is gathered in a pile 68 that is positioned immediately adjacent to the open lower end 64 of the forward plate 58 of the intake vent 56, as noted in FIGS. 1–3. The power switch 40 is then turned to an "on" position. This will activate the motor 38 whereupon the intake fan 30 will rotate. The rotation of the intake fan 30 will draw air in through the open lower end 64 of the forward plate 58 of the intake vent 56 thereby causing the pile 68 to be sucked through the open lower end 64 and travel through the channel 62 and through the open upper end 66 of the rearward plate 60 and into the collection bin 42. The filter 36 will prevent the dust particles from reaching the intake fan 30. The power switch 40 is then turned to an "off" position whereupon the collection bin 42 can be removed from the cabinet 12 for permanent disposal of the collected dust and debris. The collection bin 42 need only be emptied at times when it is full of dust and debris.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An under cabinet vacuum device for allowing swept up debris to be collected without the need for a dustpan or the like comprising, in combination:

a cabinet having an upper wall, a lower wall, a rear wall, and an open front, the open front having a door hingedly coupled thereto, the lower wall having an opening therethrough inwardly of the open front, the cabinet being positionable on an existing floor surface;

an intake fan disposed interiorly of the cabinet, the intake fan being disposed within a generally rectangular housing, the housing being secured to the lower wall of the cabinet inwardly of the rear wall thereof, the housing having an open forward wall, the open forward wall having a filter removably disposed therein, the intake fan being powered by a motor, the motor having a power switch disposed within the door of the cabinet;

a collection bin removably disposed interiorly of the cabinet upstream of the intake fan, the collection bin having a generally rectangular configuration defined by a top wall, a bottom wall, an open rear, an open front and opposed side walls, the side walls each having a handle secured thereto, the open rear being aligned with the filter of the housing of the intake fan;

an intake vent positioned within the opening in the lower wall of the cabinet, the intake vent being comprised of a forward plate and a rearward plate with a channel disposed therebetween, the forward plate having an open lower end in communication with the channel, the open lower end in fluid communication with the existing flooring surface, the rearward plate having an open upper end in communication with the channel, the open upper end in fluid communication with the open front of the collection bin.

2. An under cabinet vacuum device for allowing swept up debris to be collected without the need for a dustpan or the like comprising, in combination:

an intake fan disposed interiorly of an existing cabinet, the intake fan being powered by a motor;

a collection bin removably disposed interiorly of the cabinet upstream of the intake fan, the collection bin being defined by a top wall, a bottom wall, an open rear, an open front and opposed side walls, the open rear being aligned with the intake fan;

an intake vent extending through a floor of the cabinet, the intake vent being comprised of a forward plate and a rearward plate with a channel disposed therebetween, the forward plate having an open lower end in communication with the channel, the open lower end being exposed to an existing flooring surface on which the cabinet is positioned, the rearward plate having an open upper end in communication with the channel, the open upper end in fluid communication with the open front of the collection bin.

3. The under cabinet vacuum device as set forth in claim 2 wherein the intake fan is disposed within a generally rectangular housing, the housing having an open forward wall aligned with the open rear of the collection bin.

4. The under cabinet vacuum device as set forth in claim 3 wherein the open forward wall of the housing has a filter removably disposed therein.

5. The under cabinet vacuum device as set forth in claim 3 wherein the intake fan is powered by a motor.

6. The under cabinet vacuum device as set forth in claim 5 wherein the motor has a power switch disposed within a door of the cabinet.

7. The under cabinet vacuum device as set forth in claim 2 wherein the side walls of the collection bin each have a handle secured thereto.

* * * * *